United States Patent [19]

Ikeda

[11] Patent Number: 4,462,680

[45] Date of Patent: Jul. 31, 1984

[54] APPARATUS FOR CONTROLLING TONER DENSITY

[75] Inventor: Yoshinori Ikeda, Matsudo, Japan

[73] Assignee: Canon Kabushiki Kaisha, Tokyo, Japan

[21] Appl. No.: 378,008

[22] Filed: May 13, 1982

[30] Foreign Application Priority Data

May 20, 1981 [JP] Japan ..... 56-74987
May 20, 1981 [JP] Japan ..... 56-74988

[51] Int. Cl.[3] ..... G03G 15/00

[52] U.S. Cl. ..... 355/14 D; 355/3 DD; 118/691; 430/30

[58] Field of Search ..... 355/3 DD, 14 D, 3 DR; 324/452, 457, 71.4; 204/299 R; 222/DIG. 1; 118/689, 691; 430/30, 190

[56] References Cited

U.S. PATENT DOCUMENTS

| | | | |
|---|---|---|---|
| 3,892,672 | 7/1975 | Gawron | 324/71.4 X |
| 4,155,638 | 5/1979 | Blitzer | 118/691 X |
| 4,266,141 | 5/1981 | Hirakura et al. | 118/691 X |
| 4,343,548 | 8/1982 | Bares et al. | 355/3 DD |
| 4,357,901 | 11/1982 | Fagen, Jr. et al. | 355/3 DR X |

*Primary Examiner*—A. C. Prescott
*Attorney, Agent, or Firm*—Fitzpatrick, Cella, Harper & Scinto

[57] ABSTRACT

A toner density control apparatus which assures always the optimum toner supply and good development with toner irrespective of the kind of original to be copied and/or the number of copies to be continuously made. The apparatus has a detector for detecting the density of toner. The quantity of toner supply is controlled using a value variable at a changing rate different from the changing rate of the density difference between the reference toner density and the detected toner density.

21 Claims, 13 Drawing Figures

APPARATUS FOR CONTROLLING TONER DENSITY

BACKGROUND OF THE INVENTION

1. Field of the Invention

The present invention relates to an apparatus for controlling the density of toner. More particularly, the present invention relates to a toner density control apparatus for use in a copying machine or the like of the type in which development with toner is carried out while automatically supplying the toner according to the measured difference between the reference density of the developer and the now existing density thereof.

2. Description of the Prior Art

An apparatus for control of toner density is known and used in automatic toner supply in accordance with the difference between the reference density of the developer and the now existing density thereof. Such a toner density control apparatus has been used in particular for a two-component development type of copying machines. The principle of the known toner density control apparatus will be described with reference to FIGS. 1A through 1C.

In FIG. 1A, 1 is a reference density plate, 2 is a light source and 3 is a photo cell. To detect the density of the reference density plate 1, for example, at the time of non-development, the light from the light source 2 is projected on the plate 1 and the reflected light from the plate is received by the photo cell 3. In a determined time (for example, during the development) the reference density plate 1 is rotated about its rotation axis 2' and the light from the light source 2 is made incident upon developer 5 through a glass plate 4. The photo cell 3 receives the reflected light from the developer to measure the density of the developer. The detection voltage of the density of the reference plate 1 is applied to the negative input of a comparator 6 through a terminal $a_1$ of switch SWA shown in FIG. 1B. At the same time, the detection voltage charges a condenser C1 through R1 (at that time switch SWB is opened). With this detection voltage the condenser C1 is charged up to a level indicated by 7 in FIG. 1C.

On the other hand, the detection voltage of the density of developer 5 photo-electrically transduced by the photo cell 3 is applied to the positive input of the comparator 6 because switch SWA is in contact with terminal $a_2$ and switch SWB is ON at the time of density detection of the developer 5. The density detection voltage obtained this time is represented by level 8 in FIG. 1C. By turn-ON of switch SWB the condenser C1 is discharged through R2 as suggested by the broken line in FIG. 1C. The output of comparator 6 continues to be "1" until the voltage of the condenser C1 drops down under the detection voltage level of the developer density. The output "1" from the comparator 6 is gated by a signel S1 which is "1" during the development thereby allowing the toner supply only during the time of development. Thus, toner is automatically supplied for a supply time ΔT which is determined by:

$$\Delta T = k \cdot \Delta C$$

wherein,

C is the difference between the above two voltage levels; and k is a proportional constant determined by the function of discharge time constant $\tau$, $k=f(\tau)$ wherein the discharge time constant $\tau = C_1R_2$.

As will be understood from the above, when the values of $C_1$ and $R_2$ are once determined, the proportional constant k is directly and is uniformly determined by it. This brings about the following problems:

The consumption of toner per copy is not constant but variable depending on the kind of the original to be copied. Therefore, when a large number of copies are continuously made with a higher toner consumption per sheet, the toner supply cannot keep up with the toner consumption and gets behind the latter because of the time required for stirring toner, etc. In this case, the density control will reach an equilibrium prematurely at a lower density level than the reference level. On the contrary, when a number of copies are made from such originals which contain a large blank area and therefore consume a small amount of toner per sheet, the density control will reach an equilibrium at a higher density level than the reference level.

In this manner, according to the conventional density control system, the quality of development with toner varies greatly according to the kind of original to be copied and/or the number of copies to be continuously made. This causes the problem of degraded copies.

SUMMARY OF THE INVENTION

Accordingly it is an object of the invention to provide a toner density control apparatus which assures always the optimum toner supply and always good development with toner irrespective of the kind of original to be copied and/or the number of copies to be continuously made.

It is another object of the invention to provide a toner density control apparatus which is simple in structure and is able to supply very exact amounts of toner.

Other and further objects, features and advantages of the invention will appear more fully from the following description of preferred embodiments taken in connection with the accompanying drawings.

BRIEF DESCRIPTION OF THE DRAWINGS

FIGS. 1A to 1C illustrate the toner density control according to the prior art of which FIG. 1A shows the arrangement of the device for measuring the density of developer, FIG. 1B shows the circuit for obtaining a toner supply signal from density detection signals and FIG. 1C is a waveform chart thereof;

DETAILED DESCRIPTION OF THE PREFERRED EMBODIMENTS

Figure 1A:
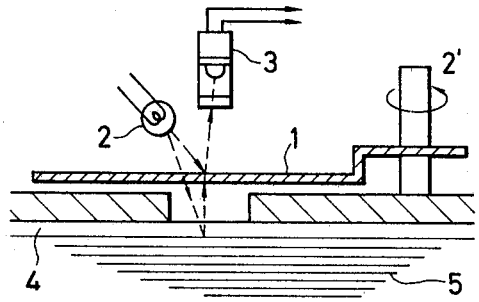
FIG. 1A PRIOR ART
Figure 2:
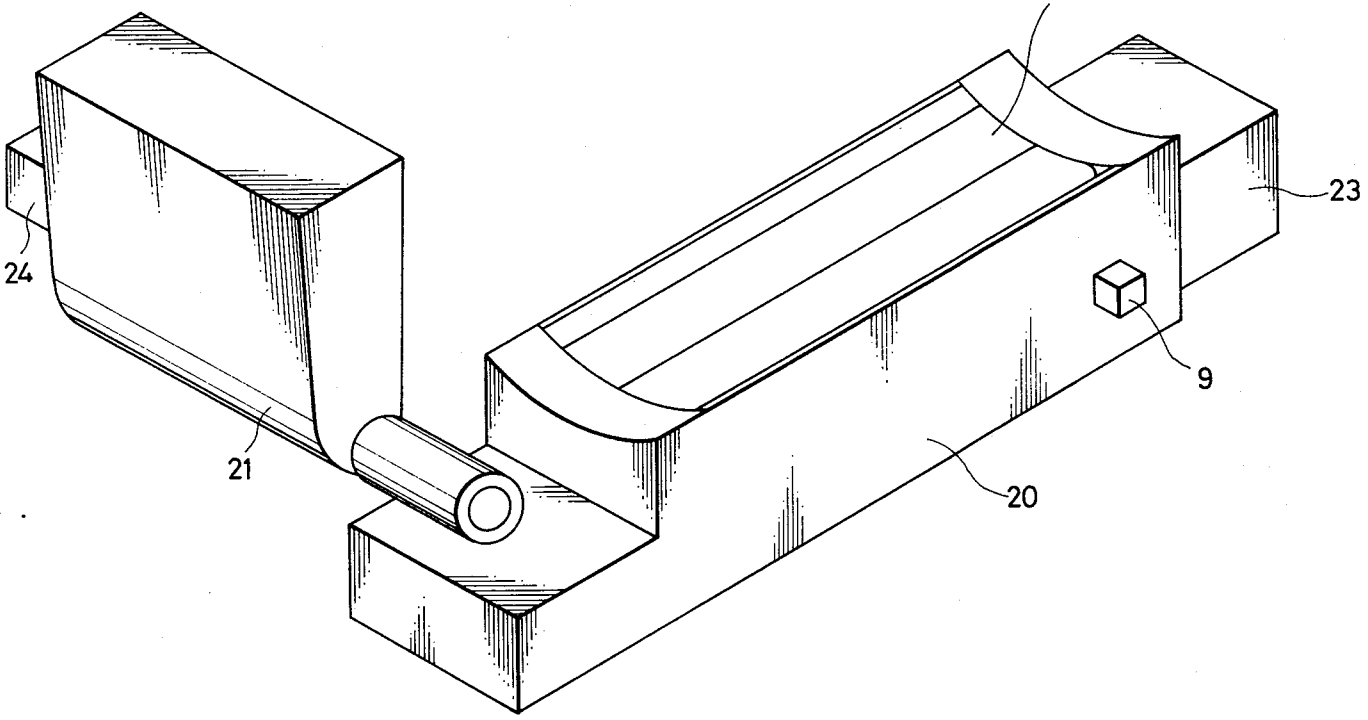
FIG. 2 schematically shows a combination of developing device and toner hopper to which the present invention is applicable.

In FIG. 2 showing a combination of developing device and toner hopper, the developing device 20 includes a sleeve 22 which is rotated by a motor 23. Although not shown in the drawing, there is provided in the developing device 20 stirring means such as a screw, a mixing blade or the like to stir the developer for uniform density of toner. The developing device 20 has a detection part 9 whose function is the same as that shown in FIG. 1A.

The toner hopper 21 is driven by a motor 24 to supply toner to the developing device 20. The toner hopper driving motor 24 is driven for a determined time by a supply signal P as later described so as to supply the toner to the developing device 20 from the toner hopper in a determined amount per unit time.

FIG. 3 shows an embodiment of the present invention. Reference characters the same as those in FIG. 1 represent the same or corresponding elements.

Figure 1B:
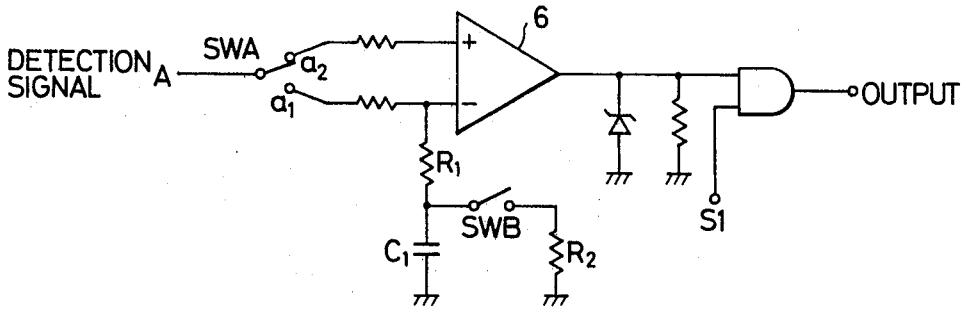
FIG. 1B PRIOR ART
Figure 1C:
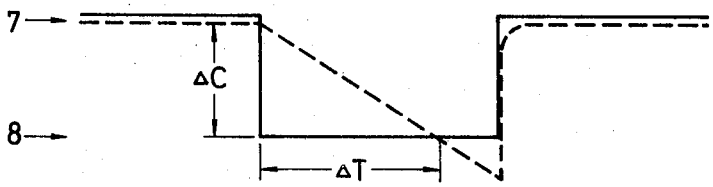
FIG. 1C PRIOR ART
Figure 3A:
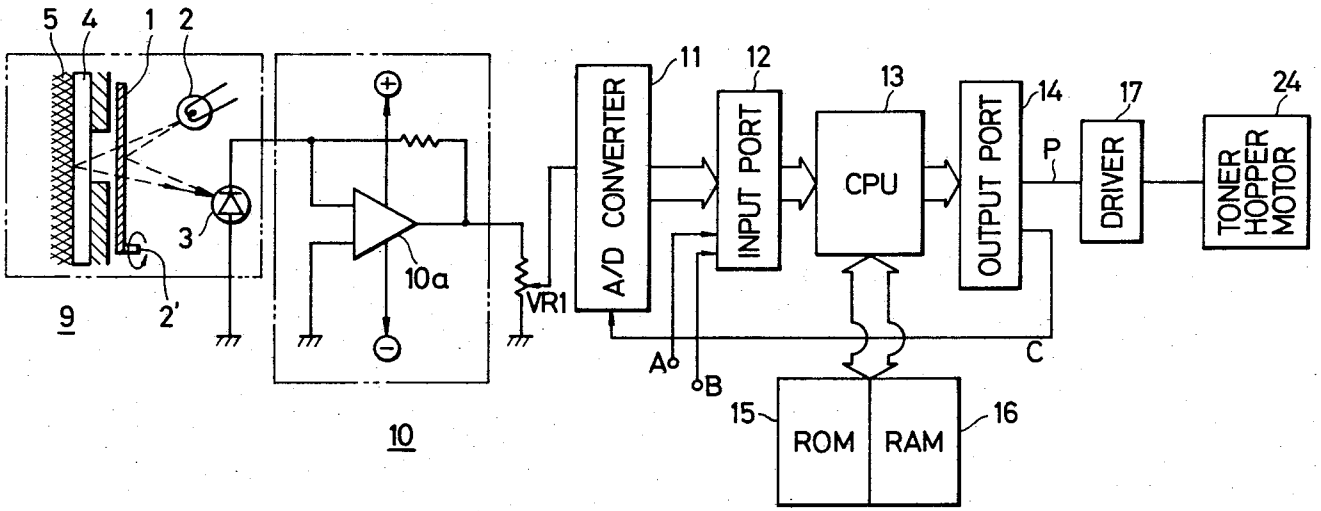
FIG. 3A is a block diagram showing an embodiment of the invention.

The structure of the detection part 9 in FIG. 3A corresponds to that in FIG. 1A and therefore need not be further described. In the manner described above, the intensity of the reference intensity plate 1 or the developer 5 is measured by the detection part 9. The detection signal from the detection part 9 is amplified by an amplifier 10 including an operational amplifier 10*a* and then the signal is level controlled by a volume VR1. Thereafter, the signal is introduced into an A/D converter 11. In the converter 11, the input detection signal is A/D converted while sampling it in a determined timing by a sampling signal appearing on a signal line C. The digitized signal (in this embodiment it is of 8-bit) is introduced into a CPU (central processing unit) 13 through an input port 12. In CPU 13 an internal arithmetic processing of the signal is executed in accordance with a program stored in ROM 15. CPU 13 puts out a supply signal P for a time given by the arithmetic processing. The supply signal P is applied to a driver 17 through an output port 14 to drive the toner hopper driving motor 24. Thus, toner is supplied for the determined time.

Figure 4:
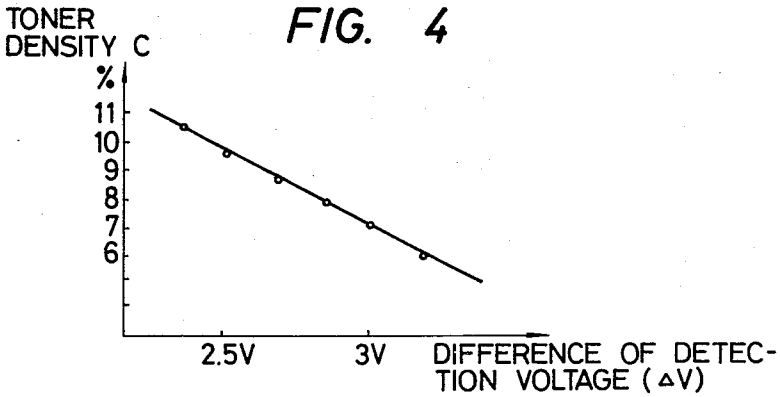
FIG. 4 is a graphical representation between detection voltage difference ΔV and toner density.
Figure 3B:
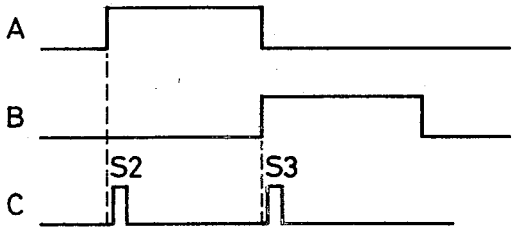
FIG. 3B is a signal waveform chart illustrating the operation of the embodiment.

In FIG. 3B, signal A is a signal informing that development is occurring and signal B is a signal informing of non-development (if A and B are contradictory to each other, there may be used only one, single signal). These signals A and B are supplied to the input port 12 in FIG. 3A. During the development A, a sampling signal S2 for density detection of the developer 5 is generated from the output port 14 to carry out the sampling of the density detection signal of developer 5 obtained by the photo cell 3. Accordingly, a digital signal corresponding to the detected density is produced from A/D converter 11. During the non-development B, there is generated a sampling signal S3 for density detection of the reference density plate 1 and a digital signal corresponding to the detected density of the reference intensity plate 1 is produced from A/D converter 11. It has been experimentally found that the relation between detection voltage difference (ΔV) and toner density (%) can be represented by a straight line as shown in FIG. 4. Herein, the difference of detection voltage (ΔV) means the difference between the detection voltage of the reference density plate 1 and the detection voltage of toner density. C denotes the toner density. Let n be the inclination of the straight line and m be a constant. Then, $$C=m+n\Delta V$$

Therefore, the difference between the reference density of developer and the existing toner density, ΔC is:

$$\Delta C=\text{reference density}-(m+n\Delta V)$$

wherein, reference density is a known value.

The density difference ΔC is obtained by arithmetic processing of the above digital value of ΔV by CPU 13. The amount of toner supply, $R_T$ is determined by:

$$R_T=k\times\Delta C$$

In this embodiment, the value of k is variable according to the value of ΔC as given below.

When $\Delta C\leqq 1\%$, $k=0.8$.

$1\%<\Delta C\leqq 2\%$, $k=1.0$.

$2\%<\Delta C\leqq 3\%$, $k=1.2$.

$3\%<\Delta C\leqq 4\%$, $k=1.4$.

$4\%<\Delta C$, $k=1.6$.

When $\Delta C\leqq 0$, $k=0$ and no toner supply is effected. The toner density C in percent (%) as used herein means the content of toner in the total of developer 100%. For an instance, when the reference density of developer, that is, the content of toner in the total amount (100%) of developer is set at 13% and the measured existing toner density is 11%, the density difference ΔC becomes 2%.

Figure 5A:
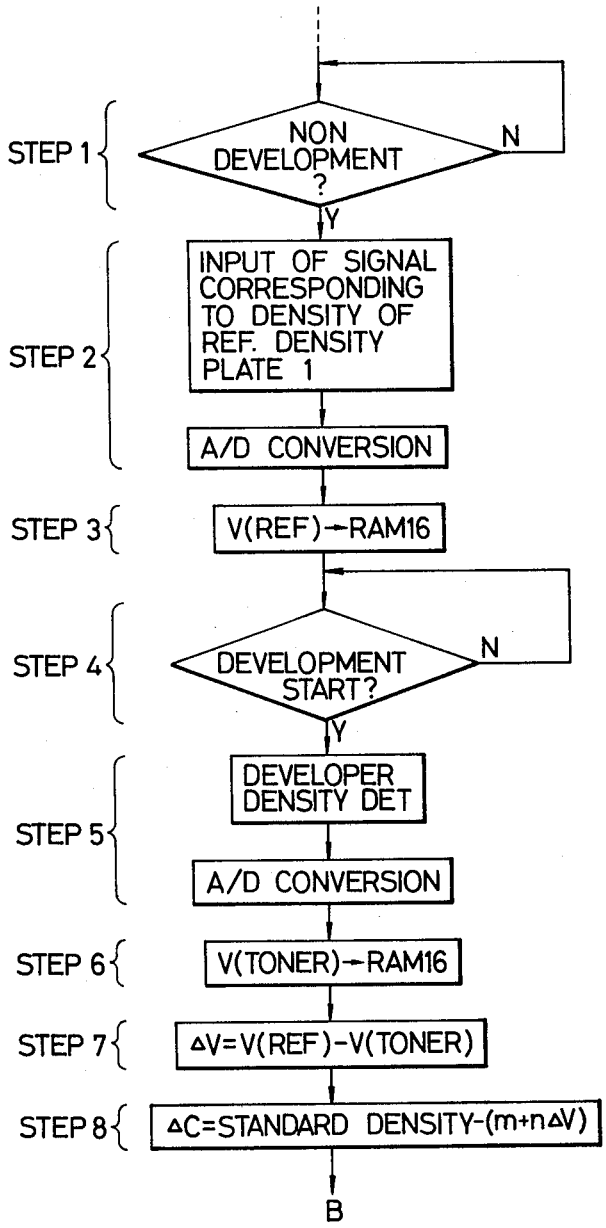
FIG. 5 composed of FIGS. 5A and 5B is a flow chart illustrating the manner of toner control according to the embodiment.
Figure 5B:
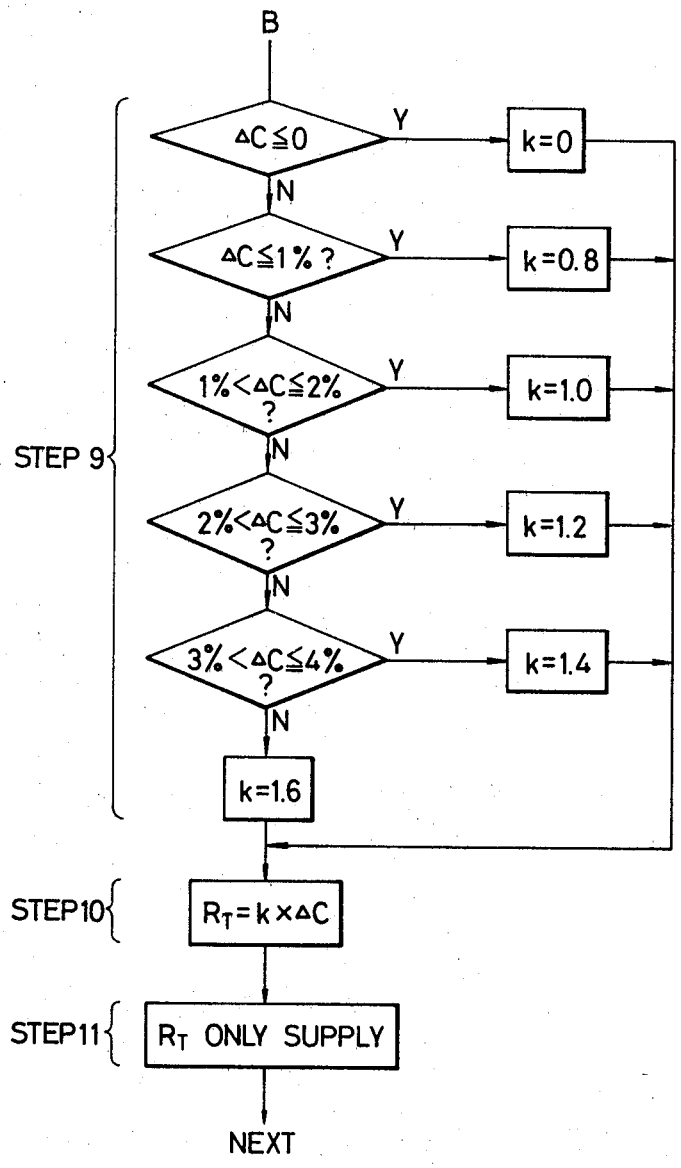

FIG. 5 is a flow chart of the program stored in ROM 15 shown in FIG. 3. The manner of operation of the above embodiment will be described hereinafter with reference to the flow chart.

At step 1, the signal B informing of non-development shown in FIG. 3B is put into the input port 12.

At step 2, the signal corresponding to the detected density of the reference density plate 1 is introduced into A/D converter 11 in a determined timing by the sampling signal S3 shown in FIG. 3B and the input density signal is digitized by A/D converter 11.

At step 3, the digitized signal is stored in a memory RAM 16 as reference voltage V(REF).

At step 4, the signal A informing of development shown in FIG. 3B is put into the input port 12.

At step 5, the sampling signal S2 for detecting the density of the developer 5 shown in FIG. 3B is generated to effect the sampling of the density detection signal of the developer 5. The sampled detection signal is digitized by A/D converter 11.

At step 6, the digitized density detection signal of the developer 5 is stored in the memory RAM 16 as toner density detection voltage V(TONER).

At step 7, computing is executed to find out the detection voltage difference ΔV between the reference voltage V(REF) and the toner density detection voltage V(TONER).

At step 8, the existing deviation of density from the reference density is calculated from the detection voltage difference ΔV. In other words, the density difference ΔC is obtained by subtracting the existing toner density of the developer (m+nΔV) from the reference density of the developer stored in RAM 16 as a predetermined value.

At step 9, the value of k is determined according to the density difference ΔC.

At step 10, a calculation of density difference $\Delta C \times k$ is carried out to find out the necessary amount of toner supply $R_T$.

At step 11, a supply signal P is issued out from the output port 14 to supply toner in the determined amount $R_T$ only. In response to the supply signal, the driver 17 drives the toner hopper motor 24 for a determined time to effect the toner supply.

In connection with the above description it is to be understood that the ranges of $\Delta C$ and the values of k shown above are mere examples and the optimum values can be selected taking into account the structure of the supply device then used as well as the characteristics of the toner then used. Also, as k there may be used a value as determined by another function of $\Delta C$. Further, another computing method than that described above may be used to calculate the amount of toner to be supplied.

As readily understood from the foregoing, the above embodiment has the following advantage over the prior art.

According to the embodiment of the invention, the amount of toner to be supplied is determined employing a particularly determined coefficient which is a function of the density difference between the reference density of developer and the existing toner density. The amount of toner to be supplied is determined by the product of the detected density difference and the coefficient. When the deviation of the toner density from the reference value becomes larger, a larger value of the coefficient is selected to increase the amount of toner supply thereby increasing quickly the toner density to the reference value. On the contrary, when the detected toner density is near the reference value, a smaller value of the coefficient is selected to prevent overshooting of the density. In this manner, according to the above embodiment, the deviation of toner density from the reference can be minimized. The toner density is therefore controlled in such a manner as to keep it, without fail, at or near the optimum value.

Figure 6A:
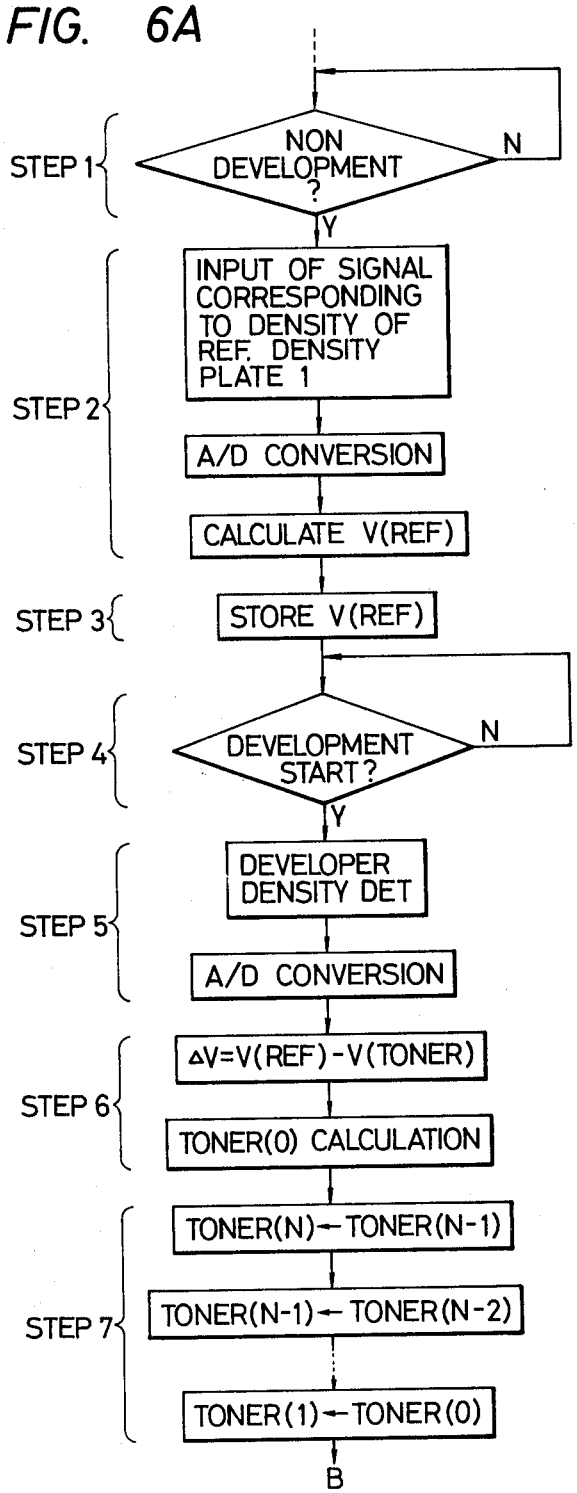
FIG. 6 composed of FIGS. 6A, 6B and 6C is a flow chart illustrating the manner of toner control according to another embodiment of the invention.
Figure 6B:
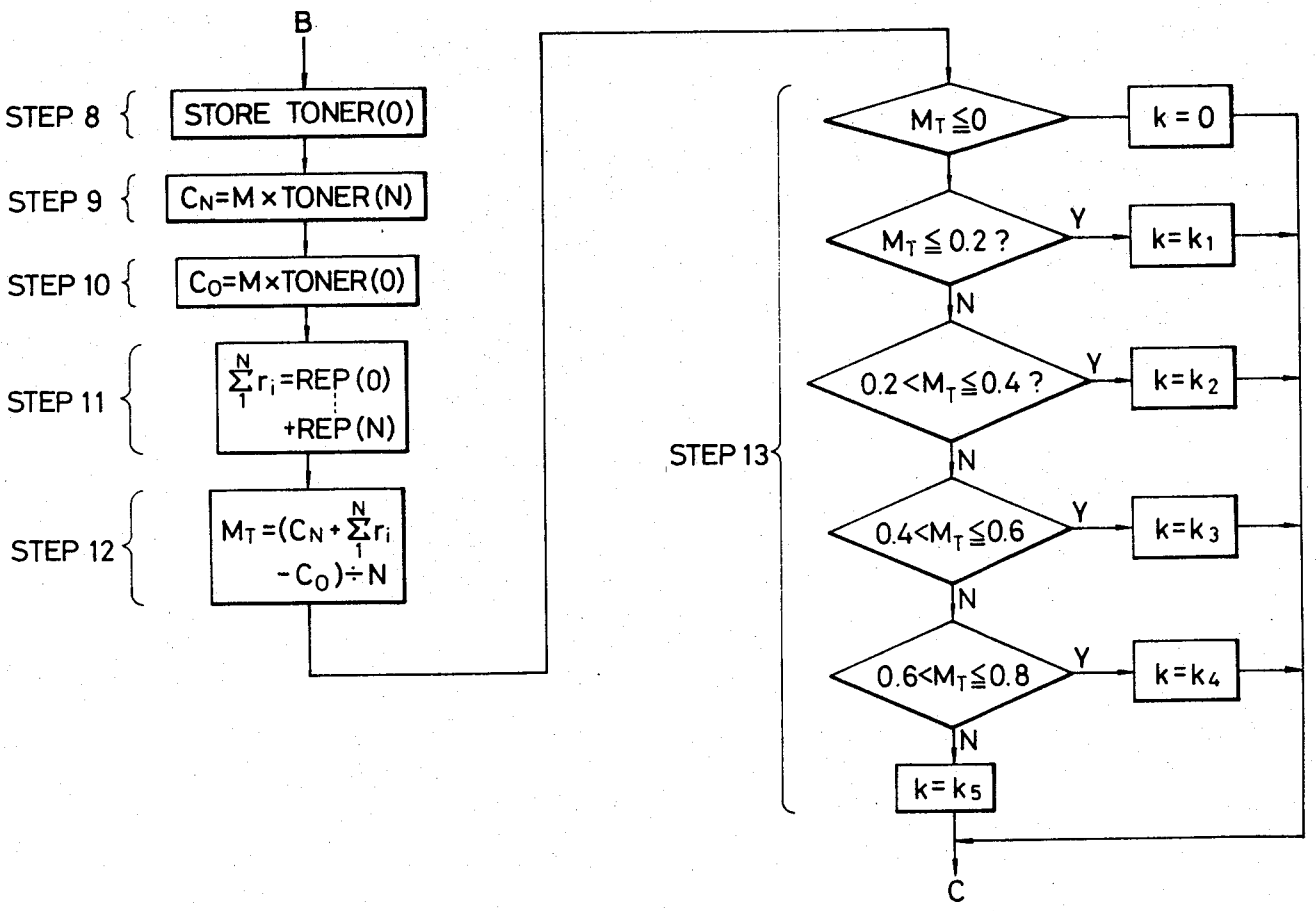
Figure 6C:
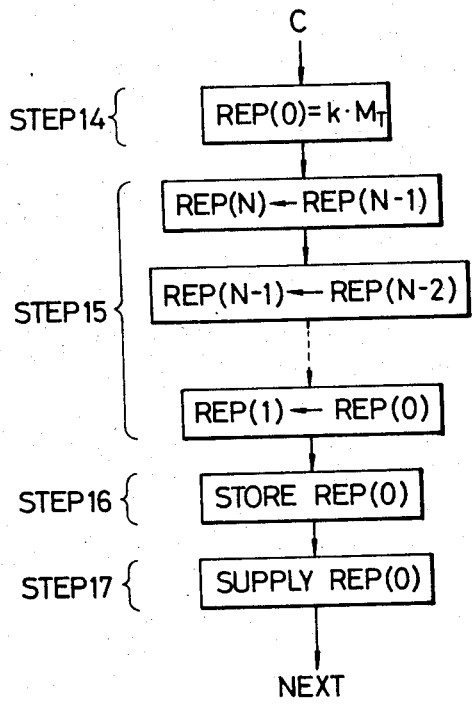

FIG. 6 is a flow chart showing another embodiment of the invention which will be described hereinafter with reference to FIGS. 2, 3, 4, 6 and 7.

In general, the total weight of developer contained in a developing device is approximately constant, which is, for example, 1 kg. Therefore, it is possible for CPU 13 to compute the toner density (%) in the developer, the amount of the deficiency of the toner (g) with respect to the reference density and the total amount of toner (g) now in the developing device. According to this embodiment, such a calculation is carried out for every development. Data obtained from the calculation and the amount of toner supply determined in the manner described are serially stored in the memory RAM 16 for the number of sheets N.

From the detected density voltage difference $\Delta V$, toner consumption per a determined number of copies, for example, toner consumption per one sheet of copy is found out, which is herein referred to as toner consumption $M_T$. The amount of toner to be supplied, $R_T$, is determined depending on the product of the toner consumption $M_T$ and a coefficient k which is a function of the toner consumption. In this embodiment, when a plural number of copies are continuously made from the same original, the toner consumption $M_T$ is calculated by the following equation:

$$M_T = \left( C_N + \sum_{1}^{N} r_i - Co \right) / N$$

wherein $C_N$ is the total amount of toner (g) for the previous N sheets;

Co is the total amount of current toner (g); and $r_i$ is the amount of toner supplied i sheets before the present ($1 \leqq i \leqq N$).

For copy making from different originals, the toner consumption is calculated as a mean value.

From the found value of the toner consumption $M_T$, the amount of toner to be supplied is given by the following equation:

$$R_T = k \times M_T$$

According to the toner consumption, the coefficient k is graded, for example, into the following five different values:

When $M_T \leqq 0.2(g)$, $k = k_1$.

$0.2(g) < M_T \leqq 0.4(g)$, $k = k_2$.

$0.4(g) < M_T \leqq 0.6(g)$, $k = k_3$.

$0.6(g) < M_T \leqq 0.8(g)$, $k = k_4$.

$0.8(g) < M_T$, $k = k_5$.

In a preferred embodiment, $k_1 < k_2 < k_3 < k_4 < k_5$ and $k_1 = 0.8$, $k_2 = 1.0$, $k_3 = 1.2$, $k_4 = 1.4$, $k_5 = 1.6$. If $k = 1.0$, then the amount of toner supplied = the amount of toner consumption. If (the toner density existing at present) $\geqq$ (the reference density), then the amount of toner supply $R_T = 0$.

Above calculations are executed in CPU 13 and the supply signal P determined by the calculations is applied to the toner hopper motor 24 through output port 14 and driver 17.

FIG. 6 is a flow chart of the program stored in ROM 15 shown in FIG. 3. The manner of operation of the above embodiment will be described hereinunder with reference to the flow chart.

At step 1, the signal B informing of non-development as shown in FIG. 3B is introduced into the input port 12.

At step 2, a density signal corresponding to the density of the reference density plate 1 is put into A/D converter 11 in a determined timing by the sampling signal S3 shown in FIG. 3B and the density signal is digitized by A/D converter.

At step 3, the digitized signal is stored in the memory RAM 16 as reference voltage V(REF).

At step 4, the signal A informing of development as shown in FIG. 3B is introduced into the input port 12.

At step 5, sampling of the density detection signal of the developer 5 is performed in accordance with the sampling signal S2 shown in FIG. 3B. The sampled signal is digitized by A/D converter 11.

At step 6, the digitized density detection signal is referred to as toner density detection voltage V(TONER). A calculation is carried out to obtain the detection voltage difference $\Delta V$ by subtracting V(TONER) from the above reference voltage V(REF). And the existing toner density C(%) of the developer is calculated from the above described formula, $m + n\Delta V$. The found toner density is referred to as TONER(0).

At step 7, data of toner density TONER(0)-—TONER(N−1) detected during the previous N cycles and previously stored in the memory RAM 16 are shifted to TONER(1)−TONER(N) and stored there.

At step 8, the toner density of the developer at present, TONER(0) is stored.

At step 9, the total amount of toner at N-th sheet before, $C_N$ is calculated. M is the total weight of the sum of toner and carrier before development.

At step 10, the total weight of toner at present, Co (g) is calculated.

At step 11, the amount of toner supplied during the cycles from N-th to 1st sheet before, $$\sum_{1}^{N} r_i$$

is calculated. Until that time, data of the amount of toner supplied $r_i$ at N-th to 1st sheet before, that is, REP(0) to REP(N) have been stored in RAM 16.

At step 12, mean toner consumption per copy, $M_T$ is calculated.

At step 13, the value of coefficient k is determined according to the found toner consumption $M_T$.

At step 14, a calculation is conducted to find out the amount of toner to be supplied this time, REP(0)$=k\ M_T$.

At step 15, data of the amount of toner supplied at the previous N cycles, namely REP(0) to REP(N−1) previously stored in RAM 16 are shifted to REP(1) to REP(N) and stored there.

At step 16, the amount of toner to be supplied this time, REP(0) is stored.

At step 17, a supply signal P is applied to the toner hopper motor 24 through output port 14 and driver 17 so as to effect toner supply in the amount of REP(0) only.

Figure 7:
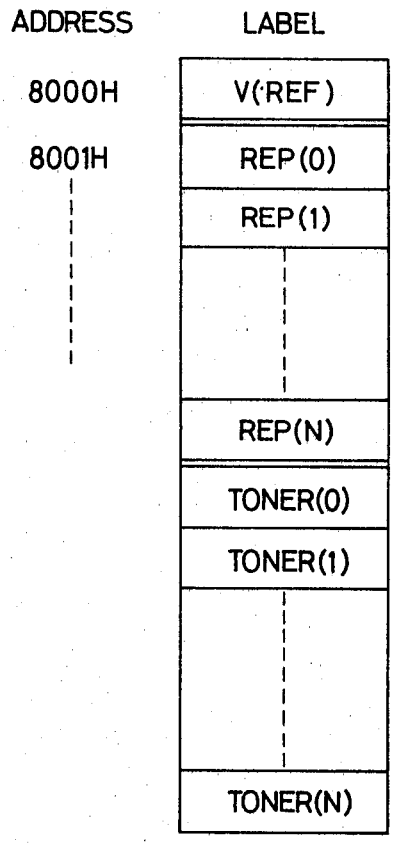
FIG. 7 illustrates the manner of how to store in a memory the result of the arithmetic processing executed by CPU 13.

Data resulting from the above arithmetic processings by CPU 13 are stored in the memory RAM 16 in the manner shown in FIG. 7. By way of example, FIG. 7 illustrates the manner how to store the data at addresses from 8000H.

In FIG. 7, V(REF) is the reference voltage at present, REP(N) is the amount of toner supplied N sheets before and TONER(N) is the toner density N sheets before. At every developing or non-developing time, there are newly obtained reference voltage V(REF), REP(0) and TONER(0). At the same time, data previously stored are shifted REP(0) to REP(1), REP(1) to REP(2) . . . REP(N−1) to REP(N). The previous REP(N) is erased from the area of RAM. This goes for TONER(N), too.

In the above embodiment, the difference of density voltage is subjected to digital processing and data obtained by the arithmetic processing are serially stored in a memory. Obviously, various modifications of the embodiment are possible in the light of the above teachings. The optimum amount of toner to be supplied this time can be determined by a simple calculation taking into account the record of past change of toner density and/or the record of past change of the amount of toner supplied.

It is to be understood that the values of k and ranges of $M_T$ given above are mere examples to illustrate a preferred embodiment and other values and ranges may be selected for k and $M_T$ as the optimum ones for the particular structure of developer supplying device then used and the characteristics of toner then used. It is also possible to select for k those values as determined by another function of $M_T$. In the above embodiment, the calculation has been made to a known toner consumption per copy. However, the same effect of the invention may be obtained also by calculating toner consumption per a determined number of copies.

The embodiment described above has the following advantage over the prior art:

According to the embodiment, toner consumption per copy or a determined number of copies is calculated from the found difference between the reference density of developer and the now existing density. The amount of toner to be supplied is determined depending on the product of the above toner consumption and a coefficient which is a function of the toner consumption. When originals which require a larger amount of toner per sheet have been continuously copied and therefore the toner density has been deviated very much from the reference value, a large coefficient is selected to increase the amount of toner to be supplied, thereby, the toner density can be increased rapidly to the reference value. On the contrary, for originals with a smaller toner consumption, a smaller coefficient is selected to prevent the toner density from becoming too high. When a continuous copy making operation is being carried out from different originals having different toner consumptions, the calculation of toner consumption is performed in such a manner as to obtain the mean value of toner consumption for N sheets. Therefore, the deviation of toner density from the reference value can be minimized.

As readily understood from the foregoing, the present invention makes it possible to supply toner always in the optimum amount for any type of originals. Even when a large number of copies are continuously produced, a very precise control of the toner supply can be attained according to the invention.

While the invention has been particularly shown and described with reference to preferred embodiments thereof, it will be obvious to those skilled in the art that various changes and modifications may be made without departing from the spirit and scope of the invention.

What I claim is:

1. An apparatus for toner density control, comprising:

means for detecting the density of a supply of toner; and means for forming a signal by which the amount of toner in the toner supply is controlled when the detected toner density differs from a reference value, said forming means forming the signal as a first signal when the difference is within a first range and forming the signal as a second signal when the difference is within a second range, wherein the rate of supply of toner varies in accordance with the detected density.

2. An apparatus for toner density control as set forth in claim 1, wherein said signal forming means forms the signal so that a rate of change of the amount of toner supply with respect to a rate of change of toner density changes toward a larger value when the difference between the detected toner density and the reference toner density is large and changes toward a smaller value when the difference is small.

3. An apparatus for toner density control as set forth in claim 2, wherein said signal forming means determines a coefficient value, which is a function of the density difference, in accordance with the density difference and forms the signal on the basis of the density difference and the coefficient value.

4. An apparatus for toner density control as set forth in claim 3, wherein said signal forming means forms the signal in accordance with a function: $\Delta C \times k$, wherein $\Delta C$ is the density difference and k is the coefficient value.

5. An apparatus for toner density control, comprising:

means for detecting the density of a toner supply; and means for forming a signal by which the amount of toner in the toner supply is controlled in accordance with the toner consumption by a determined number N of copy sheets which have used toner, said forming means forming the signal as a first signal when the detected density indicates a first toner consumption by the determined number N of copy sheets and forming the signal as a second signal when the detected density indicates a second toner consumption by the determined number N of copy sheets.

6. An apparatus for toner density control as set forth in claim 5, wherein said signal forming means calculates the toner consumption for a determined N number of copy sheets on the basis of the toner density before the N number of copy sheets, the amount of toner supplied for the N number of copy sheets and the detected toner density.

7. An apparatus for toner density control as set forth in claim 5, wherein said signal forming means forms the signal so that a rate of change of the amount of toner supply to a rate of change of the amount of the toner consumption changes toward a larger value when the toner consumption is large and changes toward a smaller value when the toner consumption is small.

8. An apparatus for toner density control as set forth in claim 7, wherein said signal forming means determines a coefficient value, which is a function of the toner consumption, in accordance with the toner consumption and forms the signal on the basis of the toner consumption and the coefficient value.

9. An apparatus for toner density control as set forth in claim 8, wherein said signal forming means forms the signal in accordance with a function: $M_T \times k$, wherein $M_T$ is the toner consumption and k is the coefficient value.

10. An apparatus for toner density control, comprising:

memory means for keeping in a memory data of the amount of toner supply supplied previously to N number of copy sheets and the toner density before the supply to the N number of copy sheets;

means for detecting current toner density;

means for calculating toner consumption by a determined number of copies from the data for the amount of toner supply supplied for the N number of copy sheets, the toner density before the N number of copy sheets and the current toner density; and means for forming a control signal to control the amount of toner supply depending on the calculated toner consumption.

11. An apparatus for toner density control as set forth in claim 10, wherein said control signal forming means forms the control signal to change the rate of change of the amount of the toner supply with respect to the rate of change of the toner consumption.

12. An apparatus for toner density control as set forth in claim 11, wherein said control signal forming means forms the control signal so that the rate of change of the amount of toner supply with respect to the rate of change of the amount of the toner consumption changes toward a larger value when the toner consumption is large and changes toward a smaller value when the toner consumption is small.

13. An apparatus for toner density control as set forth in claim 12, wherein said control signal forming means determines a coefficient value, which is a function of the toner consumption, in accordance with the toner consumption and forms the signal on the basis of the toner consumption and the coefficient value.

14. An apparatus for toner density control as set forth in claim 13, wherein said control signal forming means forms the signal in accordance with a function: $M_T \times k$, wherein $M_T$ is the toner consumption and k is the coefficient value.

15. An apparatus for toner density control, comprising:

means for detecting the density of a supply of toner; and means for forming a signal by which the amount of toner which forms the toner supply is controlled in accordance with the detected toner density, said forming means forming the signal to change a rate of change of the amount of toner supply with respect to a rate of change of the toner density.

16. An apparatus for toner density control as set forth in claim 15, wherein said signal forming means compares the detected toner density with a reference toner density, and forms the signal so that the change of the changing rate of the amount of toner supply with respect to the changing rate of the toner density is to a larger value when the difference between the detected toner density and the reference toner density is large and is to a smaller value when the difference between the detected toner density and the reference toner density is small.

17. An apparatus for toner density control as set forth in claim 16, wherein said signal forming means includes a CPU and an A/D converter, and performs a calculation with a time serial entry of the reference toner density and the detected toner density.

18. An apparatus for toner density control, comprising:

means for detecting the density of a supply of toner;

memory means for storing data associated with previous detected toner density; and means for forming a signal by which the amount of toner which forms the toner supply is controlled on the basis of the stored data.

19. An apparatus for toner density control as set forth in claim 18, said memory means stores data associated with the toner density before N number of copy sheets and the amount of toner supplied for the N number of copy sheets.

20. An apparatus for toner density control as set forth in claim 18, wherein said signal forming means forms the signal in accordance with the toner consumption by a determined N number of copy sheets.

21. An apparatus for toner density control as set forth in claim 20, wherein said signal forming means forms the signal to change the rate of change of the amount of toner supply to a rate of change of the toner consumption.

* * * * *